United States Patent [19]

Carlson

[11] 4,215,780

[45] Aug. 5, 1980

[54] CONTAINER FOR BOOKS AND ARTICLES

[75] Inventor: Frank A. Carlson, Bridgeview, Ill.

[73] Assignee: Alton Box Board Company, Alton, Ill.

[21] Appl. No.: 961,659

[22] Filed: Nov. 17, 1978

[51] Int. Cl.[2] ..... B65D 5/24; B65D 85/54

[52] U.S. Cl. ..... 206/424; 206/492; 229/40; 229/41 B

[58] Field of Search ..... 206/424, 472, 492; 229/40, 41 R, 41 B

[56] References Cited

U.S. PATENT DOCUMENTS

| | | | |
|---|---|---|---|
| 2,769,588 | 11/1956 | Beck | 229/40 |
| 3,027,063 | 3/1962 | Zastraw | 229/40 |
| 3,064,875 | 11/1902 | Mairs | 206/424 |
| 3,219,256 | 11/1965 | Zastraw | 229/40 |
| 3,289,824 | 12/1966 | Bortel | 206/424 |
| 3,386,641 | 6/1968 | Cassidy | 229/40 |
| 3,658,237 | 4/1972 | Engel | 229/41 R |
| 3,826,362 | 7/1974 | Staskus | 229/40 |

*Primary Examiner*—Herbert F. Ross
*Attorney, Agent, or Firm*—Paul M. Denk

[57] ABSTRACT

Container for books and articles of like shape formed having top, bottom, first and second side, and closure panels that are foldably connected together to form an article encompassing sleeve, end flaps created of three subpanels forming protective end cells at each end of the container, reinforcing flaps connecting to the side of each first side panel and arranged for extending into the formed air cell to reinforce it and the container's ability to resist compressive forces, and end wall panels connecting to each end of the top panel for providing closure to the end cells and the container at its ends. Reinforcing tabs are interconnected between a side of the end wall panels and the sides of the second side panel and folded to a bellows configuration for further reinforcement of the created end cells as the container is formed into its usable configuration.

12 Claims, 12 Drawing Figures

CONTAINER FOR BOOKS AND ARTICLES

BACKGROUND OF THE INVENTION

This invention relates generally to an improvement in a container, and pertains more specifically to a container for a book or the like, and which incorporates end cells that are reinforced to preferably resist against compressive forces acting upon the container when used for shipping books or the like.

Numerous styles of paperboard containers have been devised in the prior art for use in the mailing and shipment of articles, such as books, to the trade. This type of container has gained widespread acceptance in the so-called mail order book business wherein subscribers enter into a contractual arrangement for receiving periodically printed books from a publisher. And, as is well known, numerous styles of paperboard reinforcement have been built into the configured book wraps for the purpose of offering resistance against damage to the books as they are shipped, and particularly to the more vulnerable components of the book such as its spline ends and lips.

Examples of the various types of paperboard containers for use for the foregoing purposes are shown in the variety of patents that have issued to A. C. Boitel, generally entitled packages for books, and as set forth in his U.S. Pat. No. Re. 25,856, No. 3,289,824, and No. 3,325,964, all of said patents being owned by a common assignee to the invention described in this current application. As shown in these prior art patents, their structural concepts for forming paperboard into bookwraps generally incorporate the formation of end cells at the end edges of the shown packages for the purpose of giving some protection to the usually exposed or vulnerable portions of books, as just explained. And, while these types of bookwraps have worked very satisfactory throughout the years for use in the shipment and concurrent protection for books enclosed therein, it has become of vogue in recent years to ship not only the more narrower type of books to the trade, but in addition, those of larger sized volumes such as the encyclopedia, dictionary, and the like. Thus, the thickness or height of certain of these types of books now being shipped require some added protection to the formed end or air cells of the bookwrap container holding them, because the greater height added to the formed end cells generally weakens their ability to resist against damage to certain of the book components during a shipment.

Thus, in view of the foregoing, it is the principal object of this invention to provide structural means within a unitary blank for forming a book shipping container whose end cells are reinforced through integral paperboard components for the container to enhance particularly its resistance against compressive forces acting upon such during a shipment.

Another object of this invention is to provide reinforcing flaps for a shipping container incorporating end cells, and which flaps provide a substantially double closure to the normally opened air cells, while at the same time furnishing resistance against compressive forces acting upon the cells during the container usage.

Still another object of this invention is to provide for reinforcement along the side edges of formed air cells within a shipping container through the agency of bellows-like folding paperboard tabs that are formed and cooperate between the various end and side panels of the folded container.

Another object of this invention is the provision of means for compensating for paperboard warpage in the blank form just prior to its machine or hand folding into its usable configuration.

Another object of this invention is to provide clearance slots at particular locations in the formed end cells of a shipping container to assure against damage to the most vulnerable ends of the book or any article packaged therein.

These other objects will become more apparent to those skilled in the art upon reviewing the summary of this invention and upon undertaking a study of its preferred embodiment in view of its drawings.

SUMMARY OF THE INVENTION

This invention pertains to the formation of a particularly structured bookwrap container for use in the transporting and shipping of books to substantial distances, such as by way of the mails. The container is basically formed of the usual design incorporating top and bottom panels, a pair of side panels, and a closure flap that is used for the purpose of sealing the aforesaid panels into a sleeve-like configuration, for firmly embracing a book therein.

The container, as previously described, incorporates other features that add to its strength during usage, and which are designed to resist against the various types of forces, and particularly the compressive forces, that have a tendency to damage the normally exposed parts of such a volume, and that being, its spline edges and the corners of its lips. Such components are designed in the category of reinforcing flaps that foldably connect to opposite ends of one of the side panels, and after an air cell is formed for protective purposes at the upper and lower ends of the container, as it is being folded, these reinforced flaps, one located at each end, are designed for inserting inwardly of its proximate just formed end cell for the purpose of keeping the end cell erect during container folding, and at the same time, and since it is consistently maintained therein during shipment of the book laden container, said flaps have a tendency to improve the top-to-bottom compressive strength particularly on that corner where the flap originates. In addition, since the flap extends a substantial distance across the width of the formed end cell, perhaps even greater than one half of the distance across the air cell, it effectively insures enhanced strength against such compression also at those locations of the end cell where the said flap extends.

The other side panel of the bookwrap container cooperates with the end wall panels projecting from the opposite ends of the top panel, in that a pair of reinforcing tabs are foldably connected one each to the proximate side edges of the said side and end wall panels, having a fold line between each of the said pair of tabs, so that as the said side wall is folded into container closure to provide a complete closing of the container form sleeve, these reinforcing tabs cooperatively fold in the nature of bellows that extend within a contiguous region of an end cell cavity, or air cell, for furnishing enhanced strength to its respective end cell and also for the purpose of resisting the aforesaid type of compressive forces.

Further advantages designed into a container of this configuration is that due to the presence of these reinforcing means that cooperate with the end cells for the purpose of resisting compression, the container can protectively package a book of much greater thickness than customarily shipped by a corresponding type of a bookwrap of the prior art, and in addition, due to the presence of these reinforcing means that structurally brace the container during its folding, such container can now be used quite extensively in the machine packaging of books at rates of approximately seventy containers formed per minute, as opposed to the prior usage of such containers that has to be slowly hand packed, and which would result in a maximum wrapping of only five to seven blanks per minute. One reason for the enhanced efficiency in the wrapping of books through the use of the container of this invention is that in a use of the prior art type of container, where no structural reinforcement or bracing was provided during the formation of the end air cells, frequently some form of a glued area had to be provided for initially holding the cell in place, until the container had been fully folded into its bookwrapping configuration. But, in the use of the present invention, the reinforcing means, and particularly the flaps as just defined, now provide structural rigidity and placement for the end cells in their formation, while the container is being wrapped around a book, thereby eliminating a timely step of having to preglue the blank, and then adhering it in place during its formation. The blank of this invention can be, for all practical purposes, totally machine wrapped without the use of any supplemental glueing.

Some incidental advantages designed into the container of this invention include the provision of a fold line throughout the height of the carton blank, approximately at its midpoint, so that when the blanks in bulk are shipped to the packager for usage, should such blanks encounter any warpage due to their stacking or handling under stress condition, the containers can be creased at the location of this midpoint fold line, so as to compensate for any warpage that has occurred. In addition, and to further insure the protection for the aforesaid vulnerable areas of any book being packaged, and which areas can be damaged during shipment, the formation of the end cells, each of which comprises three subpanels foldably connected to an end of the bottom panel, one or more slots are formed at the sides of said subpanels at the location of their fold lines, so as to provide clearance for the lip and spline ends of the book being packaged therein, resulting in no paperboard contact with these parts of the packaged book that could transmit any damaging force to the same in the event that compression upon or dropping of the packaged book occurs during its transmission.

DESCRIPTION OF THE PREFERRED EMBODIMENT

Figure 1:
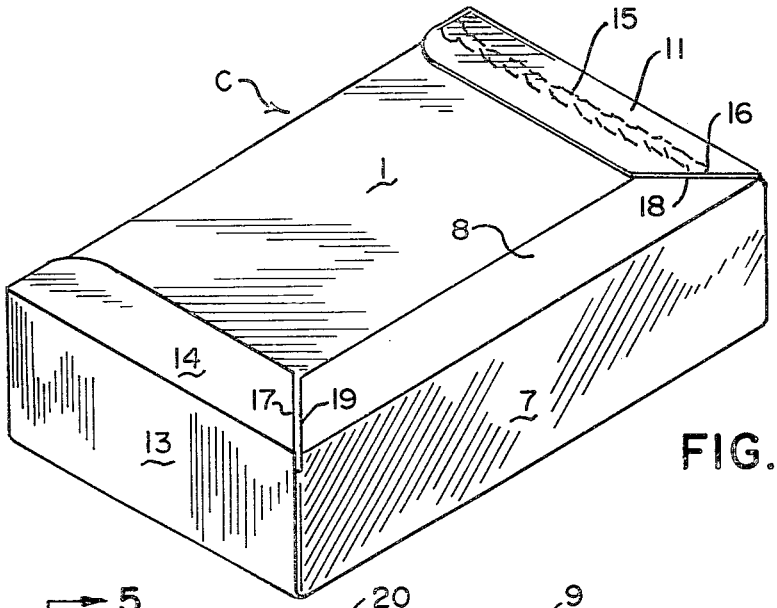
FIG. 1 provides an isometric view of the book packaging container of this invention.
Figure 2:
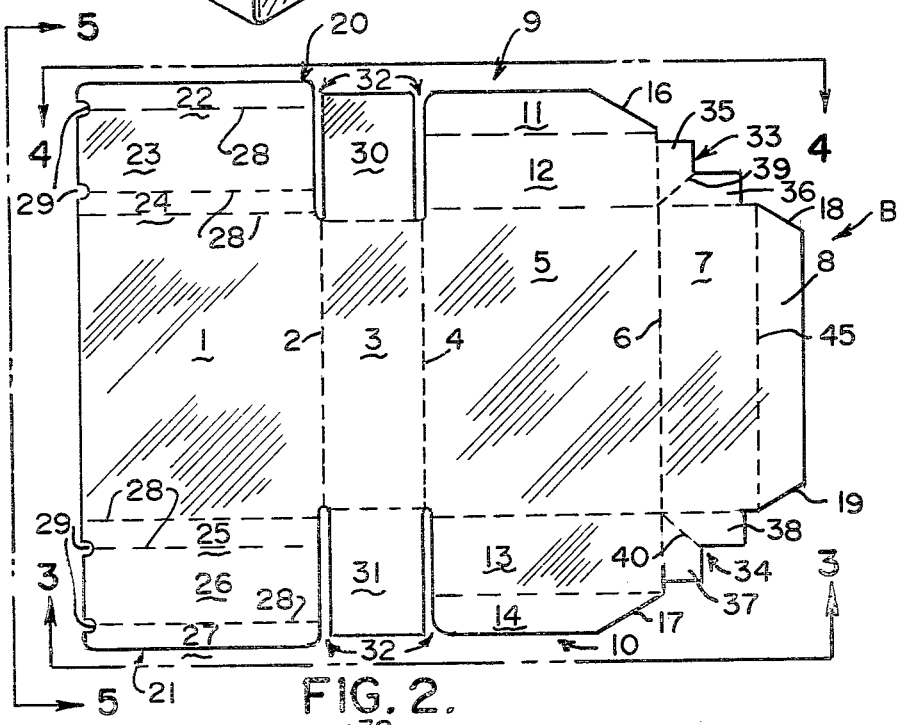
FIG. 2 provides a plan view of the blank for the container as shown in FIG. 1.
Figure 3:
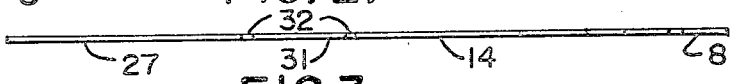
FIG. 3 furnishes a right edge view of the blank for the container, taken along the line 3—3 of FIG. 2.
Figure 4:
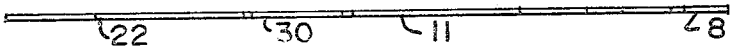
FIG. 4 provides a left edge view of the blank for the container taken along the line 4—4 of FIG. 2.
Figure 5:
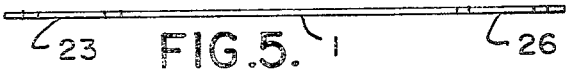
FIG. 5 is a bottom edge view of the blank for the container taken along the line 5—5 of FIG. 2.
Figure 6:
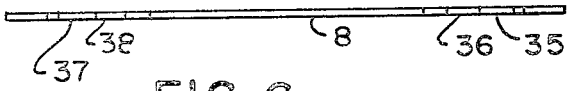
FIG. 6 is a top edge view of the blank for the container as shown in FIG. 2.

In referring to the drawings, in the particular FIGS. 1 and 2, there is disclosed, in the first named figure, an isometric view of the bookwrap container C of this invention, in its fully folded form. And in referring also to FIG. 2, the container is formed from a unitary blank B cut from a sheet of paperboard stock, preferrably corrugated board, and to enhance its rigidity during usage, corrugations are designed to extend the width of the blank, or from top to bottom of the blank as shown in FIG. 2, although such corrugated arrangement is not an absolute necessity to achieving the prime benefits and results of the inventive aspects of this design. As shown, the container is formed having a bottom panel 1 foldably connected by means of a fold line 2 with a first side panel 3, and which side panel is foldably connected by means of another fold line 4 with a top panel 5. Connected by means of another fold line 6 to said top panel is a second side panel 7, and which has foldably connected to it a closure or a sealing flap or panel 8, which when all of said panels are folded into the sleeve-like configuration, said closure flap 8 functions as a glue flap for adhering, by means of an adhesive, to the underside of the bottom panel 1, for securing said main panel into closure about the embraced book, or other article. FIG. 1, as previously explained, is actually an inverted view of the book packaging container for showing how the closure panel 8 is adhered to the bottom panel 1. Connecting at opposite ends of the top panel 5 are a pair of end wall panels 9 and 10, with each of these end wall panels being formed as a pair of flaps, 11 and 12, with respect to the panel 9, and 13 and 14, with respect to the panel 10, and these end wall panels are designed for folding over into closure against the ends of the container when it is folded into its usable configuration, as shown in FIG. 1. As can be seen, the respective flaps 11 and 14 additionally function as glue flaps, as for adhering to the underside of the bottom panel 1, as shown, and one of these flaps 11 and 14 may include a tear strip, as at 15, for the purpose of providing for ease of opening of the container, at least at one end, for removal of any book enclosed therein. In addition, and as can be seen, the flaps 11 and 14 also include beveled edges 16 and 17, and which are cut for the purpose of providing a complimental fit with the beveled edges 18 and 19 of the the closure panel 8, so as to provide for uniformity of appearance in the enclosed container as shown in FIG. 1.

As also shown in FIG. 2, means are provided for forming the end cells, or protective air cells, that function to cushion the ends of the enclosed book, and to shelter its vulnerable parts from sustaining any damage. Each of these air cells 20 and 21 are formed from a series of end flaps or subpanels, such as the subpanel 22, 23, and 24, forming the air cell 20, and the subpanels 25, 26, and 27, forming the air cell 21. As can be seen, each of these subpanels are connected together through a series of fold lines, such as the fold lines 28, with the initial fold being made about the fold lines connecting the subpanels 24 and 25 to the bottom panel 1, so that these subpanels can then be turned approximately 180° into overlying relationship against the inner end edge of the said bottom panel 1, with the major subpanels 23 and 26 then being bent perpendicularly upwardly for the full internal height of the formed container, with the final subpanels 22 and 27 being bent, once again, approximately 90° from the subpanels 23 and 26, respectively, for extending outwardly towards the end edge of the container, and being arranged contiguous against the interior end edges of the top panel 5, as when the container is finally folded into closure. Thus, an air cell approximating the dimension of the widths of the subpanels 22, 24, 25, and 27, and the height of the subpanels 23, and 26, are provided at each end of the container, when folded, to insulate the ends of the books against any impacting type of damage. Furthermore, and it can also be seen in this FIG. 2, that slots, as at 29, are cut at the ends of the fold lines 28 separating the various subpanels, and the slots are provided at this location so as to provide for complete clearance for the end edges of either the lips, or the spline ends of the book embraced by the container, so that should any impacting force be exerted upon the container end wall panels, such force will not be transmitted to such normally easily damaged edges of a packaged book.

In the folding of the container of this invention, and since this container has a slightly greater height, as can be determined from reviewing the height of the panels 7 and 13, in FIG. 1, when such a height is built into the container, part of its structural strength is relinquished. Hence, and to remedy this matter, reinforcing means, in the nature of reinforcing flaps 30 and 31, are foldably connected to opposite ends of the first side panel 3, so that after the air cells 20 and 21 are folded into their operative position within the folding container, these reinforcing flaps 30 and 31 are folded into the air cell to provide means for supporting and retain the air cells in their initially folded position, and in addition, once the container is fully formed, these reinforcing flaps substantially aid in resisting any top-to-bottom compressive forces that may be exerted upon the top and bottom panels of the container. As can be seen, the spacing between these reinforcing flaps 30 and 31, and their contiguous end cells 20 and 21, respectively, and end wall panels 9 and 10, is of some width, so as to provide adequate clearance for the unencumbered insertion of these reinforcing flaps 30 and 31 into the air cell during the folding of the carton. These slots are more accurately depicted at 32.

In addition to the foregoing, and to insure adequate strength for the end cells at their opposite ends from the location of the just described reinforcing flaps 30 and 31, a series of additional reinforcing means, as at 33 and 34, are provided intermediate the end wall panels and the second side panel 7. Each of these reinforcing means comprises a pair of tabs, as at 35 and 36, with respect to the reinforcing means 33, and 37 and 38, with respect to the reinforcing means 34, with each of these reinforcing tabs being secured together by means of the respective fold lines 39 and 40. As can also be seen, the reinforcing tab 35 is foldably connected with the end wall flap 12, and at the same time, the reinforcing tab 36 is foldably connected with the second side panel 7. Likewise, the reinforcing tab 37, at the other end of said second side panel, is foldably connected with the end wall flap 13, while its associated reinforcing tab 38 is foldably connected with the opposite side of the second side panel 7. Thus, and as can be seen in FIG. 7, as the container being folded into its usable configuration, these reinforcing tabs 35 through 38 fold inwardly with respect to each other, as about their fold lines 39 and 40, into a bellows-like configuration, and become arranged within the proximate end of the air cell to add further reinforcement to these end cells for resisting any compressive forces exerted upon the container during usage.

Figure 7:
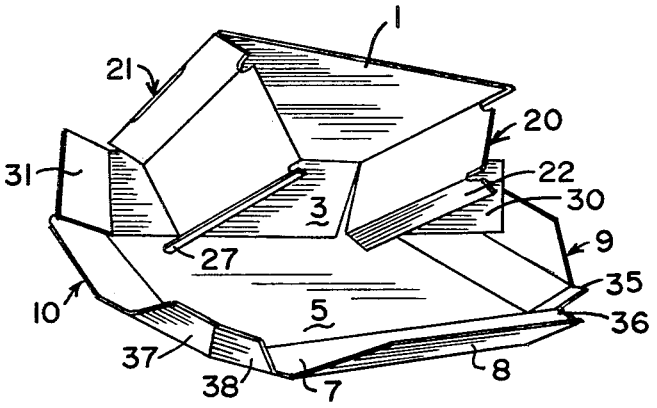
FIG. 7 discloses an isometric view of the blank for the container as it is being folded into a book embracing configuration.

As further shown in said FIG. 7, and while the container is being folded from the blank form into its applicable form, the bottom wall 1 will be rested upon the folding machine surface, and a book laid thereon. Actually, the entire blank, and this bottom wall, will be located upon the surface in a planar position. For the sake of rendering the folding sequence more clear, the container is actually inverted in FIG. 7 from its actual disposition during usage. In any event, the initial folds are made between the bottom wall 1 and the first side wall 3, with the end cells 20 and 21 then being folded into their air cell formation, not too unlike the position of these type of subpanels as previously explained in earlier prior art patents. Then, the top panel 5 is folded into overlying relationship against the arranged subpanels 22 and 27, with the second side panel 7 then being folded into closure for creating the container sleeve formed from the various major panels into their container shape. Finally, the closure panel 8 is adhered to underside of the bottom panel 1, as by means of a glue, or the like, for securing these major panels of the container into their book embracing position. At this stage, the reinforcing flaps 30 and 31 are folded into their respective proximate formed air cells formed from the end cells 20 and 21, and therein assist in the erection of the said end cells, and likewise, provide for the resistance against compressive forces as previously explained. And, as can be seen these reinforcing flaps 30 and 31 extend some distance into the air cells, even to the extend that they may extend more than half way across the formed air cell, to provide adequate resistance against top-to-bottom compressive forces that may be applied to either of the top and bottom panels during usage of the container. Furthermore, as the second side panel 7, and its foldably connected closure panel 8, are folded into closure against the container, the reinforcing tabs 35 through 38 are by necessity buckled about their respective fold lines 39 and 40 inwardly, and come to rest arranged within the proximate ends of the previously formed air cells, of the end cells 20 and 21, to add further reinforcement at this side edge of the container, and likewise resist against the type of compressive forces that may be exerted upon the container at this location. Finally, during the formation of these reinforcing tabs into the position as just explained, simultaneously with this process will be the folding of the end wall panels 9 and 10, respectively, about their end cell 20 and 21, so as to provide closure for the container at each end in the manner as shown in FIG. 1.

Figure 8:
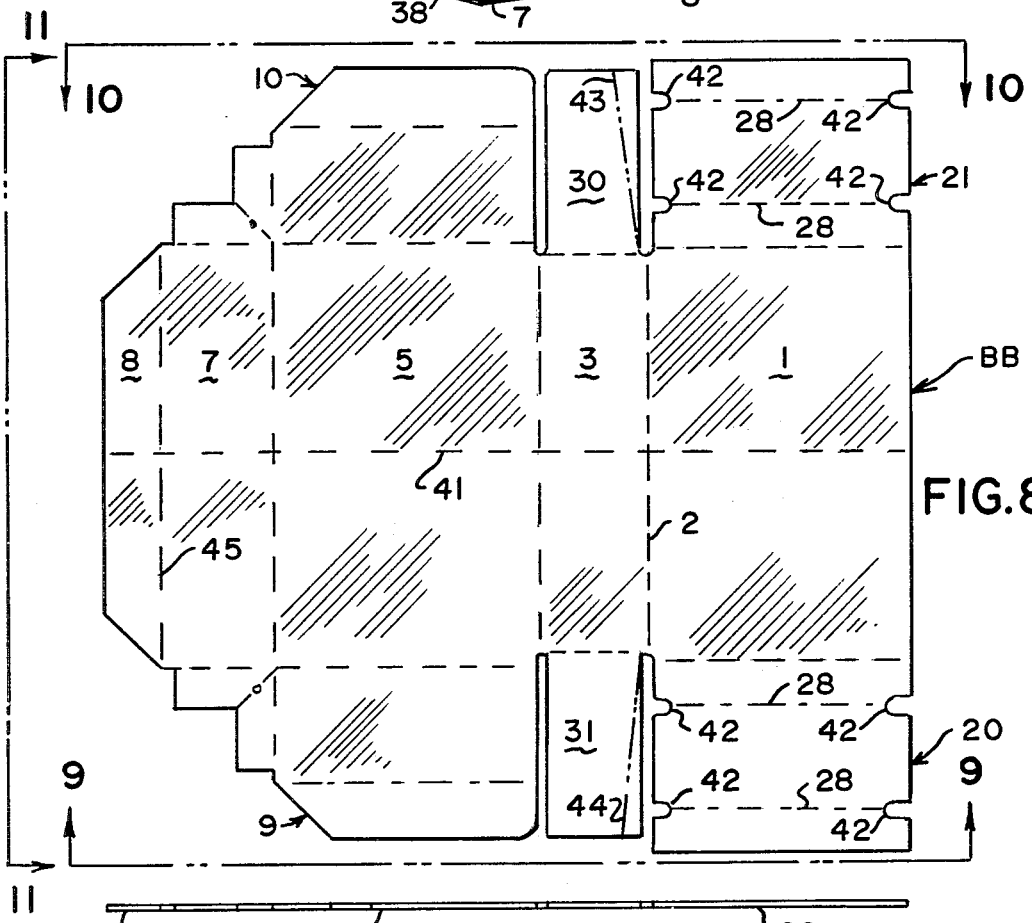
FIG. 8 provides a plan view of a slightly modified blank for the container of this invention.
Figure 9:
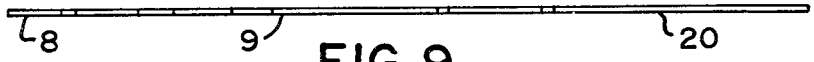
FIG. 9 furnishes a left edge view fo the blank taken along the line 9—9 of FIG. 8.
Figure 10:
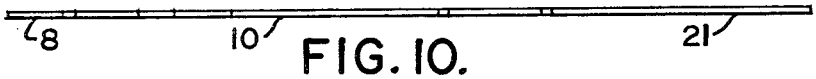
FIG. 10 provides a right edge view of the blank for the container taken along the line 10—10 of FIG. 8.
Figure 11:
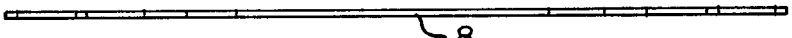
FIG. 11 provides a top edge view of the blank for the container taken along the line 11—11 of FIG. 8.
Figure 12:
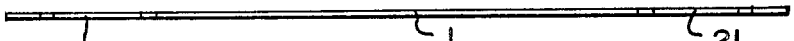
FIG. 12 provides a bottom edge view of the blank for the container as shown in FIG. 8.

Slight modifications to the container of this invention, and more specifically its blank, are shown in FIG. 8. This blank BB is formed of the same panels and flaps as previously explained with respect to the blank B, and for this reason, the various identified panels are furnished with the same reference characters for purposes of identification and structural location. In this particular configured blank, it can be seen that a crease or fold line 41 is provided approximately centrally along the midpoint of the height of the container blank as shown. And, when these blanks are cut and shipped to a customer for use in the packaging of books, or the like, frequently warping will take place of the blank for a variety of reasons. And, to compensate against any warping that is exhibited in a blank as it is being fed into a folding carton machine, the blank may be slightly bent about its crease line 41 so as to eliminate any such warpage from the same before it is exposed to the various operating mechanisms that provide for the complete mechanical folding of such a carton about a book. In addition, and to fully insure that adequate clearance is provided simultaneously for both of the end edges of the book lips and its spline, slots 42 are provided at both ends of each of the fold lines 28 forming the separations between the various subpanels of the end cells 20 and 21, as shown. Furthermore, and to insure the adequate clearance for the insertion of the reinforcing flaps 30 and 31 into the air cells of the end cells 20 and 21 during formation of the container, these flaps may be cut along a bevel, as at 43 and 44, to insure their ease and unobstructed insertion intermediate the upper and lower subpanels of each of the end cells 20 and 21 as just previously formed in the container as it is being wrapped around a book.

In addition to the foregoing, the first and last fold lines 2, and 45, provided between various main panels of the container may be formed as a male-female crease, or as a female score, as is known in the paperboard art, for the purpose of insuring that the proper folding sequence occurs for the various panels and flaps of this container during this machine folding into its usable configuration. Furthermore, the tear strip 15, as previously explained, could also be located within the closure flap 14, or the closure panel 8, and therein function to provide means for the quick and easy access into the container to achieve a prompt removal of its packaged book.

The foregoing provides a rather detailed description of the preferred embodiment of this invention. The description, as set forth, is mainly provided for illustrative purposes only. Any variations of modifications to the structure of this development, within the spirit of its invention, and the scope of the appended claims, are intended to be protected by any United States patent issuing upon this invention.

Having thus described the invention, what is claimed and desired to be secured by Letters Patent is:

1. A container for books and articles of like shape comprising a sheet of foldable board having top, bottom, first and second side panels, and closure panels foldably connected to form and article-encompasing sleeve of length greater than the article, said bottom panel having opposite end flaps for forming end cells extending approximately the width thereof, each end cell formed having three subpanels that extend for erection inwardly of the ends of the top and bottom panels for forming said air cells thereat, end wall panels foldably connecting with each end of the top panel, and said end wall panels disposed for providing closure for the formed end cells at each end of the container, the improvement which comprises, a reinforcing means foldably secured to each end of each side panel, the configuration of the reinforcing means of the first of said side panels being distinctively dissimilar to the configuration of the reinforcing means of the second of said side panels, and said means disposed for arrangement within their proximate formed end cells at each end thereof to provide for cell reinforcement and to enhance the top-to-bottom panel compressive strength of the container at each of its ends, the reinforcing means connecting at the ends of first side panel comprising reinforcing flaps, with a reinforcing flap connecting with each end of the said first side panel and extending for a distance across the length of and into a formed end cell, the reinforcing means connecting with the ends of the second side panel comprising a pair of tabs, one tab of each pair foldably connecting with the end edge of the said second side panel, the other tab of each pair foldably connecting with the approximate side edge of the said end wall panel, and each of said pair of tabs being foldably connected together along a fold line and to provide for their collapsing into the bellows form for locating within the formed end cell and enhancing its reinforcement after folding of the container into its usable configuration.

2. The invention of claim 1 and wherein said reinforcing flaps extend more than half way across the width of the formed air cells.

3. The invention of claim 1 and wherein each reinforcing means comprises a pair of tabs, one tab of each pair foldably connecting with the end edge of the second side panel, the other tab of each pair foldably connecting with the proximate side edge of the said end wall panel, and each said pair of tabs being foldably connected together along a fold line to provide for their collapsing into the bellows form for locating within the formed air cell and embracing its reinforcement after folding of the container into its usable configuration.

4. The invention of claim 1 and wherein the said reinforcing flaps projecting from the first side panel, and the bellows form reinforcing means operatively associated with the said second side panel furnish reinforcement to opposite ends of the container and within each of the formed end cells.

5. The invention of claim 1 and wherein said reinforcing flaps are tapered along their full length to facilitate their insertion within the end cells during container formation.

6. The invention of claim 1 and including a fold line extending fully across the midpoint of the foldable board forming the container and useful for creasing of the container in the blank form to compensate for board warpage before its formation into the said container form.

7. The invention of claim 1 and wherein the three subpanels of each end flap are separated by fold lines, and there being a slot formed at the ends of each fold line between subpanels at least along one side of each end flap.

8. The invention of claim 7 and wherein there being a slot formed at the end of each fold line between subpanels along both sides of each end flap.

9. A blank for a container for shipping books and articles of like shape comprising a unitary sheet of foldable board having bottom, first side, top, second side panels, and closure panels all foldably connected together along parallel fold lines and capable of being folded into an article-encompassing sleeve of length greater than the article to be packaged, end flaps connecting to each end of the said bottom panel, each end flap being formed into three subpanels connected by fold lines and which when folded are capable of forming end cells at the ends of the container, end wall panels foldably connecting with each end of the top panel, said end wall panels disposed for providing closure for the formed end cells at each end of the container, reinforcing means structurally connected to each end of the first and second side panels and when folded capable of inserting within and reinforcing the formed end cells and the container against the top-to-bottom panel compressive forces, the reinforcing means connected to the first side panel having a configuration distinctively dissimilar to the configuration of the reinforcing means connected to the second side panel, siad reinforcing means at each end of the first side panel comprising a reinforcing flap foldably connected therewith along a fold line, said reinforcing means at the end of the second panel comprising a pair of tabs foldably connected therewith, one tab of each pair connecting with each end of said second side panel, and the other tab of each pair connecting with the proximate edge of the end wall panel, said pair of tabs being connected together along a fold line, whereby each said pair of tabs being capable of collapsing into the bellows form for disposition within and reinforcing the proximate end cell against top-two-bottom compressive forces when the container is folded from the blank form into its usable configuration.

10. The invention of claim 9 and including reinforcing means also connecting at the ends of the other said side panel, said reinforcing means comprising a flap foldably connecting to the end of said side panel and in the blank form being arranged aligned therewith.

11. The invention of claim 10 and including a fold line extending fully across the midpoint of the blank for the container and useful for creasing the said container in the blank form to compensate for board warpage before its formation into a container.

12. The blank of claim 10 and wherein there being a slot formed at the end of at least one of the fold lines formed between subpanels of the end flaps for providing clearance for the contiguous component of any article to be packaged within the container when folded into its usable configuration.

* * * * *

UNITED STATES PATENT AND TRADEMARK OFFICE

CERTIFICATE OF CORRECTION

PATENT NO. : 4,215,780
DATED : August 5, 1980
INVENTOR(S) : Frank A. Carlson

It is certified that error appears in the above-identified patent and that said Letters Patent are hereby corrected as shown below:

claim 3, column 8, line 32, Change "embracing" to ---enhancing---.

claim 9, column 9, line 11, Change "siad" to ---said---.

Signed and Sealed this

*Eleventh* Day of *November 1980*

[SEAL]

*Attest:*

SIDNEY A. DIAMOND

*Attesting Officer*

*Commissioner of Patents and Trademarks*